US009376188B2

(12) United States Patent
Okamoto

(10) Patent No.: US 9,376,188 B2
(45) Date of Patent: Jun. 28, 2016

(54) JET PROPULSION BOAT

(71) Applicant: YAMAHA HATSUDOKI KABUSHIKI KAISHA, Iwata-shi, Shizuoka (JP)

(72) Inventor: Yukitaka Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 559 days.

(21) Appl. No.: 13/858,119

(22) Filed: Apr. 8, 2013

(65) Prior Publication Data

US 2014/0096505 A1 Apr. 10, 2014

(30) Foreign Application Priority Data

Oct. 5, 2012 (JP) ..... 2012-223185

(51) Int. Cl.

| | |
|---|---|
| ***B63H 11/08*** | (2006.01) |
| ***B63H 11/11*** | (2006.01) |
| ***B63H 21/21*** | (2006.01) |
| *B63H 11/113* | (2006.01) |

(52) U.S. Cl.

CPC ..... *B63H 11/08* (2013.01); *B63H 11/11* (2013.01); *B63H 21/21* (2013.01); *B63H 11/113* (2013.01); *B63H 2021/216* (2013.01)

(58) Field of Classification Search

CPC ..... B63H 20/08; B63H 20/12; B63H 25/42; B63H 25/46; B63H 25/48; B63H 11/101; B63H 11/107; B63H 11/113; B63H 11/117; B63H 21/21; B63H 2021/216

USPC ..... 440/38, 40, 42, 43

See application file for complete search history.

(56) References Cited

U.S. PATENT DOCUMENTS

| | | | | |
|---|---|---|---|---|
| 6,733,350 | B2 * | 5/2004 | Iida | B63H 21/22 440/84 |
| 6,913,496 | B2 * | 7/2005 | Fuse | B63B 1/18 440/41 |

FOREIGN PATENT DOCUMENTS

| | | | |
|---|---|---|---|
| JP | 09-132196 | A | 5/1997 |

* cited by examiner

*Primary Examiner* — Andrew Polay

(74) *Attorney, Agent, or Firm* — Keating and Bennett, LLP

(57) ABSTRACT

A deflector control portion in a jet propulsion boat causes a deflector to swing by controlling a deflector drive mechanism in response to an operation of a shift operating portion. The deflector control portion causes the deflector to move to a first trim position when the shift operating portion is switched to a forward movement shift position. The deflector control portion causes the deflector to move to a second trim position when the shift operating portion is switched to an operating shift position.

7 Claims, 7 Drawing Sheets

| | State | 1 | 2 | 3 | 4 |
|---|---|---|---|---|---|
| Pattern 1 | Shift position | F | N | F | - |
| | Trim position | UP2 | N | UP2 | |
| | | UP1 | N | UP1 | - |
| | | N | N | N | - |
| | | DN1 | N | DN1 | - |
| | | DN2 | N | DN2 | - |
| Pattern 2 | Shift position | F | R | F | - |
| | Trim position | UP2 | N | UP2 | |
| | | UP1 | N | UP1 | - |
| | | N | N | N | - |
| | | DN1 | N | DN1 | - |
| | | DN2 | N | DN2 | - |
| Pattern 3 | Shift position | F | R | N | F |
| | Trim position | UP2 | N | N | UP2 |
| | | UP1 | N | N | UP1 |
| | | N | N | N | N |
| | | DN1 | N | N | DN1 |
| | | DN2 | N | N | DN2 |

FIG. 5

| State | Traveling | ENG stop | ENG start | Traveling |
|---|---|---|---|---|
| Shift position | F | N | N | F |
| Trim position | UP2 | N | N | UP2 |
| | UP1 | N | N | UP1 |
| | N | N | N | N |
| | DN1 | N | N | DN1 |
| | DN2 | N | N | DN2 |

FIG. 7

JET PROPULSION BOAT

BACKGROUND OF THE INVENTION

1. Field of the Invention

The present invention relates to a jet propulsion boat.

2. Description of the Related Art

A jet propulsion boat moves forward due to the backward discharge of a jet flow from a jet propulsion mechanism. The jet propulsion boat is equipped with a bucket to change the direction of the jet flow from the jet propulsion mechanism. The bucket is arranged to allow movement to a forward movement position and to an operating position. The forward movement position is a position where the bucket moves away from the jet orifice of the jet flow. The operating position is a position where the bucket is facing the jet orifice of the jet flow. For example, the jet propulsion boat can move in reverse by positioning the bucket in the operating position. Alternatively, the jet propulsion boat can stop by positioning the bucket in the operating position.

The jet propulsion boat also includes a deflector. The deflector is arranged to swing upward and downward and to allow the jet flow direction to be changed upward and downward. Conventionally, the position of the deflector is manually changed by a mechanism for trim adjustment. The trim adjustment is an operation that changes the direction of the deflector upward and downward in order to change the angle of rake in the forward and backward direction of the boat body. For example, the operator uses the trim adjustment to change the orientation of the jet propulsion boat to one that the operator finds easier to operate. Alternatively, the operator uses the trim adjustment to change the orientation of the jet propulsion boat in response to the number of riders.

In a reverse motion device for a motorboat disclosed in Japanese Laid-open Patent Publication No. H9-132196, the bucket is moved to the operating position and the steering nozzle is angled upward when the reverse lever is set to the reverse motion position. Accordingly, there is an improvement in reverse motion performance.

Japanese Laid-open Patent Publication No. H9-132196 does not disclose anything about adjusting the position of the steering nozzle except for when the motorboat moves in reverse. Thus, even if the reverse movement performance can be temporarily improved, the boat body of the motorboat cannot be stabilized and controlled when switching the reverse lever to a shift position other than the reverse movement position. Alternatively, after switching the reverse lever to a shift position other than the reverse movement position, the operator must manually operate the steering nozzle using the trim adjustment in order to move the steering nozzle to a suitable position. This type of operation is troublesome for the operator.

SUMMARY OF THE INVENTION

Preferred embodiments of the present invention provide a jet propulsion boat that stabilizes and controls the boat body when shifting the bucket.

The jet propulsion boat according to a preferred embodiment of the present invention includes a boat body, an engine, a jet propulsion mechanism, a deflector, a bucket, a shift operating portion, a deflector drive mechanism, a storage portion, and a deflector control portion. The engine is housed inside the boat body. The jet propulsion mechanism is configured to generate a propulsion power from a driving power of the engine. The deflector includes a jet orifice to discharge a jet flow backward from the jet propulsion mechanism. The deflector is arranged to swing upward and downward. The deflector is configured to change the direction of the jet flow upward and downward. The bucket is arranged behind the deflector. The bucket is configured to move to a forward movement position and to an operating position. The forward movement position is a position in which the bucket is moved to a position away from facing the jet orifice of the jet flow. The operating position is a position in which the bucket is moved to a position facing the jet orifice of the jet flow. The shift operating portion is configured to be switched between a forward movement shift position and an operating shift position. The forward movement shift position is a position of the shift operating portion corresponding to the forward movement position of the bucket. The operating shift position is a position of the shift operating portion corresponding to the operating position of the bucket. The deflector drive mechanism is configured to cause the deflector to swing. The storage portion stores a first trim position and a second trim position as swing positions of the deflector. The deflector control portion is programmed to cause the deflector to swing by controlling the deflector drive mechanism in response to an operation of the shift operating portion. The deflector control portion is programmed to cause the deflector to move to the first trim position when the shift operating portion is switched to the forward movement shift position. The deflector control portion is programmed to cause the deflector to move to the second trim position when the shift operating portion is switched to the operating shift position.

In the jet propulsion boat according to a preferred embodiment of the present invention, the deflector automatically moves to the second trim position when the shift operating portion is switched to the operating shift position. As a result, the boat body can be stabilized and controlled. The deflector automatically moves to the first trim position from the second trim position when the shift operating portion is switched from the operating shift position to the forward movement shift position. Thus, operation of the jet propulsion boat is convenient since the operator does not need to manually switch the deflector positions.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 5 is a table of trim position changes according to the first trim position control.

FIG. 7 is a table of trim position changes according to the second trim position control.

DETAILED DESCRIPTION OF THE PREFERRED EMBODIMENTS

Figure 1:
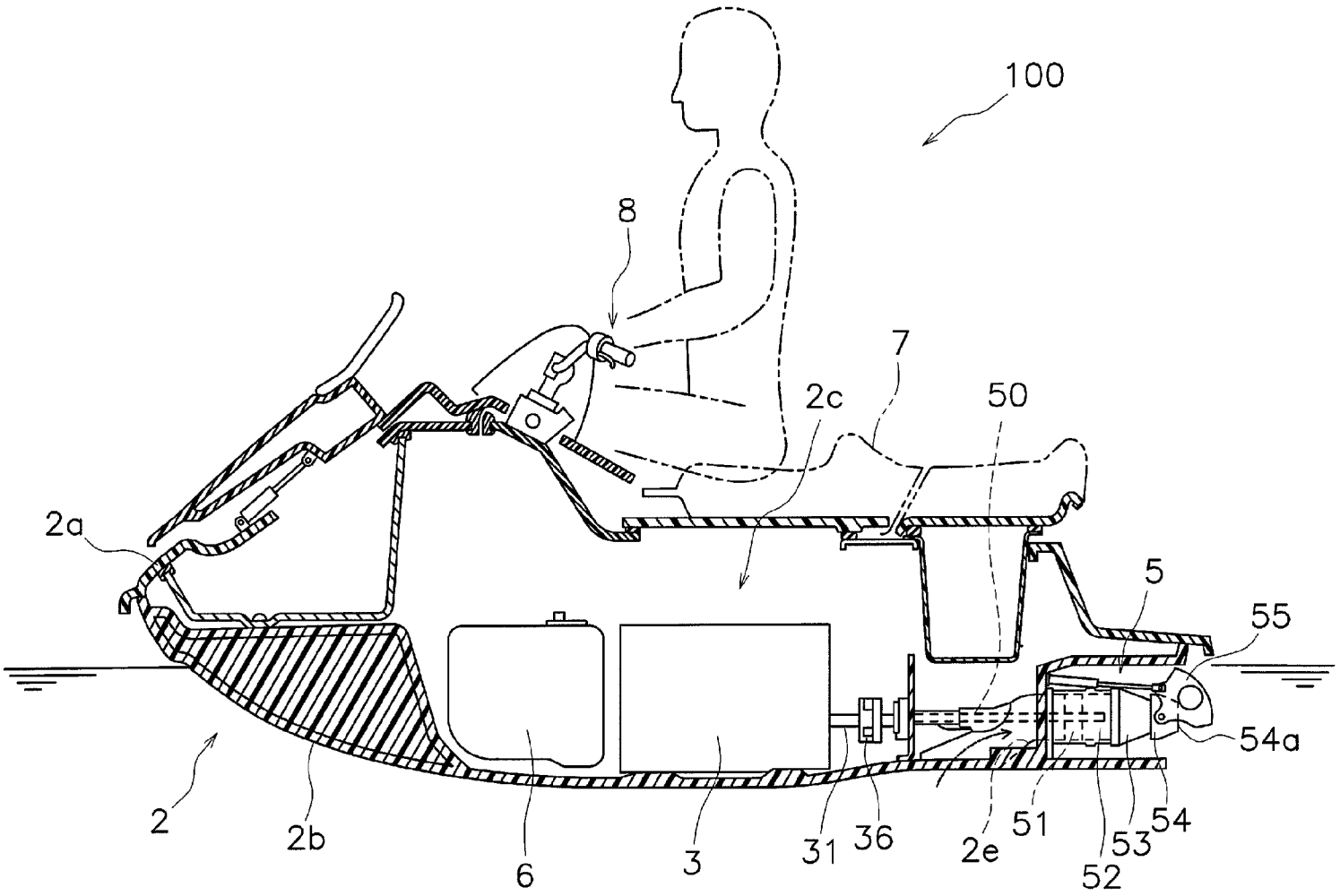
FIG. 1 is a cross-sectional view of the main configuration of a jet propulsion boat according to a preferred embodiment of the present invention.

The jet propulsion boat according to preferred embodiments of the present invention will be explained below with reference to the attached drawings. FIG. 1 is a cross-sectional view of the main configuration of a jet propulsion boat according to a preferred embodiment of the present invention. The jet propulsion boat 100 is preferably a so-called personal watercraft (PWC), for example. The jet propulsion boat 100 includes a boat body 2, an engine 3, and a jet propulsion mechanism 5. The boat body 2 includes a deck 2*a* and a hull 2*b*. An engine room 2*c* is provided inside the boat body 2. The engine room 2*c* houses the engine 3 and a fuel tank 6 and the like. A seat 7 is attached to the deck 2*a*. The seat 7 is arranged above the engine 3. A steering handle 8 for steering the boat body 2 is arranged in front of the seat 7. The engine 3 includes a crankshaft 31. The crankshaft 31 is arranged so as to extend toward the front and back.

The jet propulsion mechanism 5 generates propulsion power to propel the boat body 2 from driving power of the engine 3. The jet propulsion mechanism 5 sucks in and discharges water around the boat body 2. The jet propulsion mechanism 5 includes an impeller shaft 50, an impeller 51, an impeller housing 52, a nozzle 53, a deflector 54, and a bucket 55.

The impeller shaft 50 is arranged to extend backward from the engine room 2*c*. The front portion of the impeller shaft 50 is coupled to the crankshaft 31 through a coupling portion 36. The back portion of the impeller shaft 50 passes through a water suction portion 2*e* of the boat body 2 to the inside of the impeller housing 52. The impeller housing 52 is coupled to the back portion of the water suction portion 2*e*.

The nozzle 53 is arranged behind the impeller housing 52. The impeller 51 is attached to the back portion of the impeller shaft 50. The impeller 51 is arranged inside of the impeller housing 52. The impeller 51 rotates with the impeller shaft 50 to suck in water from the water suction portion 2*e*. The impeller 51 discharges the sucked in water backward from the nozzle 53.

The deflector 54 is arranged behind the nozzle 53. The deflector 54 includes a jet orifice 54*a* that discharges a jet flow backward from the jet propulsion mechanism. The deflector 54 is configured to divert the discharge direction of water from the nozzle 53 to the left or to the right in response to an operation of the steering handle 8.

Figure 2A:
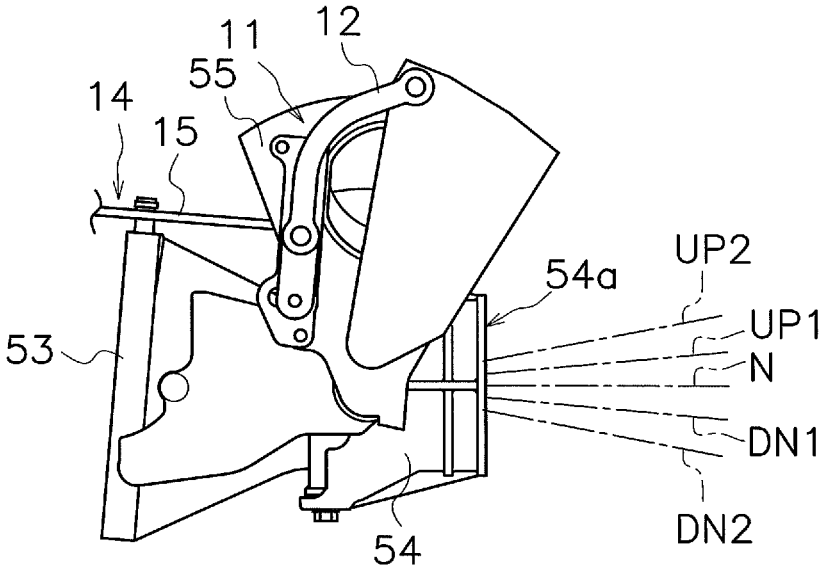
FIGS. 2A-2C illustrate side views of a portion of the jet propulsion mechanism of the jet propulsion boat.
Figure 2B:
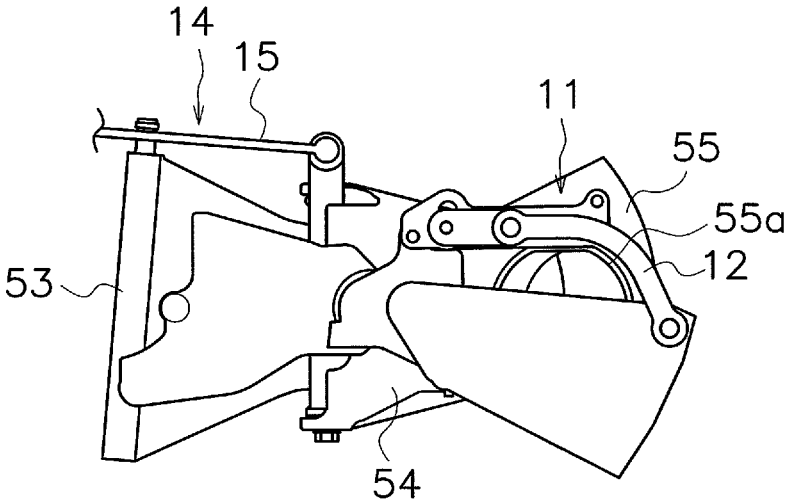
Figure 2C:
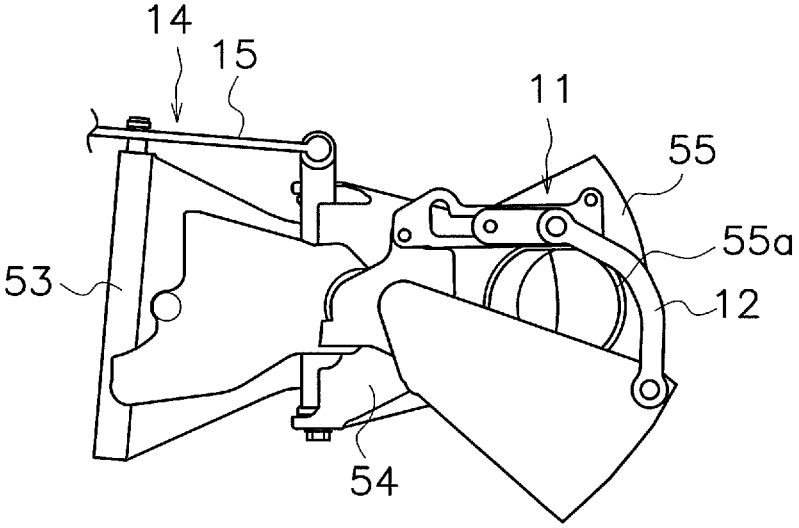
Figure 3:
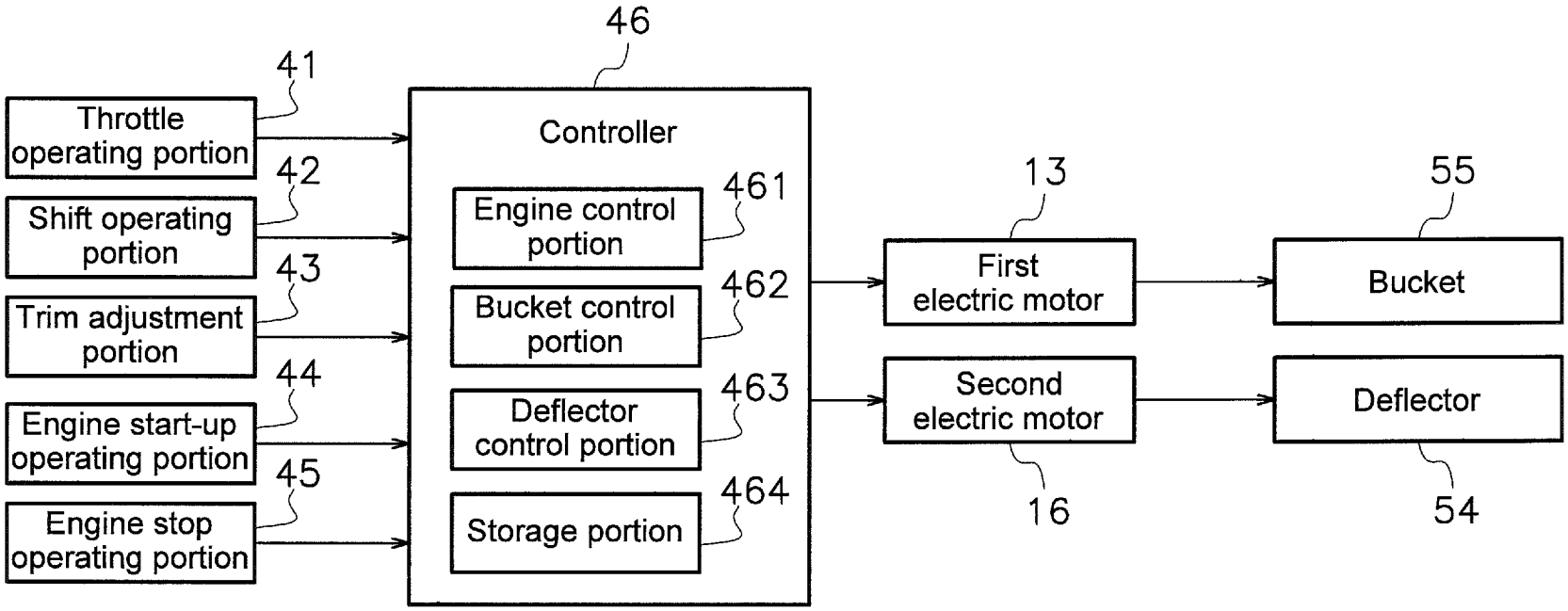
FIG. 3 is a block diagram of a control system of the jet propulsion boat.

The bucket 55 is arranged behind the deflector 54. The bucket 55 is configured to be able to divert the discharge direction of water from the nozzle 53 and the deflector 54 to the front or to the left and right. FIGS. 2A-2C illustrate side views of a portion of the jet propulsion mechanism 5. FIG. 3 is a block diagram of a control system of the jet propulsion boat 100.

As illustrated in FIGS. 2A-2C, the jet propulsion boat 100 includes a bucket drive mechanism 11. The bucket drive mechanism 11 includes a first link mechanism 12 illustrated in FIGS. 2A-2C, and a first electric motor 13 illustrated in FIG. 3. The bucket 55 is attached to the nozzle 53 through the first link mechanism 12. As a result, the bucket 55 is arranged in a manner that allows movement between a forward movement position, a first operating position, and a second operating position. The bucket 55 is driven by the first electric motor 13 to move between the forward movement position, the first operating position, and the second operating position. FIG. 2A illustrates a state in which the bucket 55 is in the forward movement position. FIG. 2B illustrates a state in which the bucket 55 is in the first operating position. FIG. 2C illustrates a state in which the bucket 55 is in the second operating position.

As illustrated in FIG. 2A, a state is entered in which the bucket 55 in the forward movement position is moved away from a position facing the jet orifice 54*a*. The bucket 55 in the forward movement position does not change the direction of the jet flow from the jet propulsion mechanism 5. Therefore, the bucket 55 in the forward movement position allows the boat body 2 to move forward.

As illustrated in FIG. 2B, a state is entered in which the bucket 55 in the first operating position faces the jet orifice 54*a*. The bucket 55 in the first operating position changes the direction of the jet flow from the jet propulsion mechanism 5 to flow toward the front of the boat body 2. Therefore, the bucket 55 in the first operating position allows the boat body 2 to move in the reverse direction. Specifically, the first operating position is a reverse movement position.

As illustrated in FIG. 2C, a state is entered in which the bucket 55 in the second operating position faces the jet orifice 54*a*. The bucket 55 in the second operating position changes the direction of the jet flow from the jet propulsion mechanism 5 to flow toward the left and the right of the boat body 2. Specifically, an opening 55*a* provided on one side of the bucket 55 is opened widely. Although not illustrated, an opening provided on the other side of the bucket 55 is also opened widely. As a result, the amount of jet flow sprayed out in the left and right directions from the bucket 55 is increased. As a result, the boat body 2 maintains a fixed position. Specifically, the second operating position is a neutral position.

The deflector 54 is arranged to swing upward and downward and is able to change the upward and downward direction of the jet flow orientation. In FIG. 2A, the chain lines UP1, UP2, N, DN1, DN2 depict center lines of the deflector 54. The jet propulsion boat 100 includes a deflector drive mechanism 14. The deflector drive mechanism 14 causes the deflector 54 to swing up and down. The deflector drive mechanism 14 includes a second link mechanism 15 illustrated in FIGS. 2A-2C and a second electric motor 16 illustrated in FIG. 3. The second link mechanism 15 transmits an operation of the second electric motor 16 to the deflector 54. As a result, a trim position of the deflector 54 is changed. The trim position is a position that represents the orientation of the deflector 54 upward and downward. In FIG. 2A, UP1, UP2, N, DN1, DN2 represent the trim positions of the deflector 54. Herein, UP1 is a first up trim position, UP2 is a second up trim position, N is a neutral trim position, DN1 is a first down trim position, and DN2 is a second down trim position. The second electric motor 16 is controlled independently from the first electric motor 13. Therefore, the deflector drive mechanism 14 and the bucket drive mechanism 11 are arranged to allow mutually independent movement.

As illustrated in FIG. 3, the jet propulsion boat 100 includes a throttle operating portion 41, a shift operating portion 42, a trim adjustment portion 43, an engine start-up operating portion 44, an engine stop operating portion 45, and a controller 46. The throttle operating portion 41, the shift operating portion 42, the trim adjustment portion 43, the engine start-up operating portion 44, and the engine stop operating portion 45 are operated by an operator. The throttle operating portion 41 is an operating member to adjust the rotation speed of the engine 3. The throttle operating portion 41, for example, is a lever attached to the steering handle 8. A throttle operation signal that indicates an operation amount of the throttle operating portion 41 is input into the controller 46.

The shift operating portion 42 is an operating member to switch a steering state of the boat body 2 between forward movement, reverse movement, and holding a fixed position. The shift operating portion 42, for example, is a switch attached to the steering handle 8. The shift operating portion 42 is arranged to switch between the forward movement shift position, the first operating shift position, and second operating shift position. The forward movement shift position is a position of the shift operating portion 42 corresponding to the forward movement position of the bucket 55. The first operating shift position is a position of the shift operating portion 42 corresponding to the first operating position of the bucket 55. The second operating shift position is a position of the shift operating portion 42 corresponding to the second operating position of the bucket 55. A shift operation signal that indicates an operation of the shift operating portion 42 is input into the controller 46.

The trim adjustment portion 43 is a member to adjust the trim position of the deflector 54. The trim adjustment 43, for example, is a switch attached to the steering handle 8. The trim adjustment portion 43 is arranged to switch between a plurality of trim adjustment positions. The trim adjustment positions are positions of the trim adjustment portion 43 corresponding to the trim positions of the deflector 54. Specifically, the trim adjustment portion 43 is able to set a first up trim adjustment position, a second up trim adjustment position, a neutral trim adjustment position, a first down trim adjustment position, and a second down trim adjustment position. The first up trim adjustment position is a position of the trim adjustment portion 43 corresponding to the first up trim position UP1. The second up trim adjustment position is a position of the trim adjustment portion 43 corresponding to the second up trim position UP2. The neutral trim adjustment position is a position of the trim adjustment portion 43 corresponding to the neutral trim position N. The first down trim adjustment position is a position of the trim adjustment portion 43 corresponding to the first down trim position DN1. The second down trim adjustment position is a position of the trim adjustment portion 43 corresponding to the second down trim position DN2. A trim adjustment signal that indicates an operation of the trim adjustment portion 43 is input into the controller 46.

The engine start-up operating portion 44 is a member to start the engine 3. The engine start-up operating portion 44 is, for example, a switch. An engine start-up signal that indicates an operation of the engine start-up operating portion 44 is input into the controller 46. The engine stop operating portion 45 is a member to stop the engine 3. The engine stop operating portion 45 is, for example, a switch. An engine stop signal that indicates an operation of the engine stop operating portion 45 is input into the controller 46.

The controller 46 is, for example, a computer that includes a CPU and memory and the like. The controller 46 includes an engine control portion 461, a bucket control portion 462, a deflector control portion 463, and a storage portion 464. The engine control portion 461 controls the engine 3. The engine control portion 461 is programmed to adjust the rotation speed of the engine 3 in response to the throttle operation signal from the throttle operating portion 41.

The bucket control portion 462 is programmed to move the bucket 55 by controlling the bucket drive mechanism 11 in response to an operation of the shift operating portion 42. Specifically, when the shift operating portion 42 is set in the forward movement shift position, the bucket control portion 462 moves the bucket 55 to the forward movement position. Consequently, the boat body 2 moves forward. When the shift operating portion 42 is set in the first operating shift position, the bucket control portion 462 moves the bucket 55 to the first operating position. Consequently, the boat body 2 moves in reverse. Alternatively, the boat body 2 can decelerate while moving forward. When the shift operating portion 42 is set in the second operating shift position, the bucket control portion 462 moves the bucket 55 to the second operating position. As a result, the boat body 2 maintains a fixed position. Alternatively, the boat body 2 can decelerate while moving forward.

The deflector control portion 463 is programmed to move the deflector 54 by controlling the deflector drive mechanism 14 in accordance with an operation of the trim adjustment portion 43. Specifically, the deflector control portion 463 moves the deflector 54 to the various trim positions in response to a trim adjustment position of the trim adjustment portion 43.

The storage portion 464 stores the first trim position and the second trim position. The first trim position is a trim position set by an operation of the trim adjustment portion 43. The storage portion 464 stores the latest trim position when the bucket 55 is in the forward movement position as the first trim position. Therefore, when the operator operates the trim adjustment portion 43 to change the trim position, the storage portion 464 updates the first trim position to the trim position after changing. The second trim position is a specific position stored as a prescribed value in the storage portion 464. The second trim position is a position in which the boat body 2 is not moved in the forward or reverse direction, in other words, the second trim position is the neutral trim position N.

Figure 4:
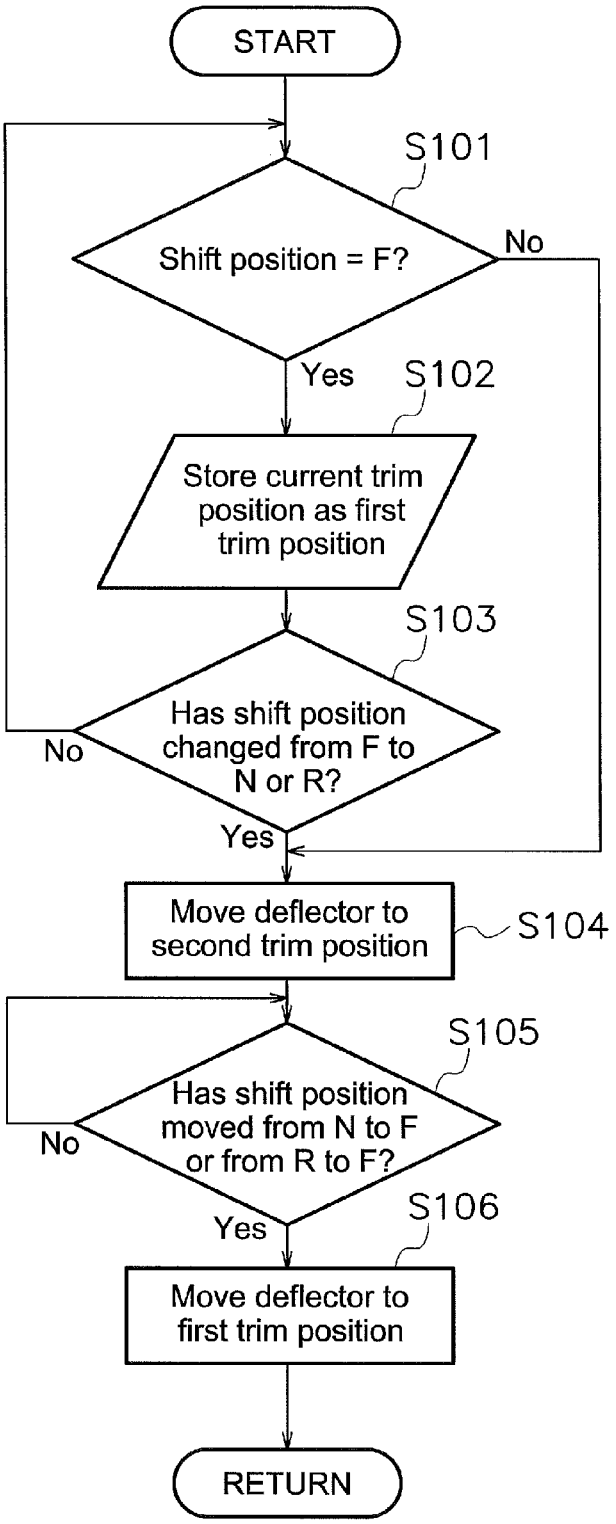
FIG. 4 is a flow chart of a first trim position control processing.

The deflector control portion 463 is programmed to control the trim positions in response to operations of the shift operating portion 42. The following is an explanation of the trim position control (referred to as "first trim position control") in response to an operation of the shift operating portion 42. FIG. 4 is a flow chart of the first trim position control processing.

In step S101, the deflector control portion 463 is programmed to determine whether the bucket 55 position (referred to below as "shift position") is the forward movement position (F). For example, the deflector control portion 463 determines the shift position of the bucket 55 on the basis of the position of the shift operating portion 42. The routine advances to step S102 if the shift position is the forward movement position (F)

In step S102, the deflector control portion 463 is programmed to store the current trim position in the storage portion 464. Specifically, the deflector control portion 463 saves the position of the deflector 54 set by the trim adjustment portion 43 as the first trim position in the storage portion 464. For example, the deflector control portion 463 stores the trim position corresponding to the current trim adjustment position of the trim adjustment portion 43 as the current trim position in the storage portion 464.

In step S103, the deflector control portion 463 is programmed to determine whether the shift position has changed from the forward movement position (F) to the second operating position (N) or to the first operating position (R). If the shift position has not changed from the forward movement position (F) to the second operating position (N) or the first operating position (R), the routine returns to step S101. If the shift position has changed from the forward movement position (F) to the second operating position (N) or the first operating position (R), the routine advances to step S104. The routine advances to step S104 if the shift position is not the forward movement position (F) in step S101.

In step S104, the deflector control portion 463 is programmed to cause the deflector 54 to be moved to the second trim position. Specifically, the deflector control portion 463 causes the deflector 54 to be moved to the neutral trim position N. Therefore, the deflector 54 moves from the current trim position set by the trim adjustment portion 43 to the neutral trim position N.

In step S105, the deflector control portion 463 is programmed to determine whether the shift position has been changed from the second operating position (N) to the forward movement position (F), or from the first operating position (R) to the forward movement position (F). If the shift position has not been changed from the second operating position (N) to the forward movement position (F) or from the first operating position (R) to the forward movement position (F), the determination in step S105 is repeated. Specifically, the deflector 54 is held in the neutral trim position N. If the shift position has been changed from the second operating position (N) to the forward movement position (F) or from the first operating position (R) to the forward movement position (F), the routine advances to step S106.

In step S106, the deflector control portion 463 is programmed to cause the deflector 54 to be moved to the first trim position. Specifically, the deflector control portion 463 returns the deflector 54 to the trim position stored in the storage portion 464 in step S102. Therefore, for example, if the first up trim position UP1 is stored in the storage portion 464 as the first trim position, the deflector 54 moves from the neutral trim position N to the first up trim position UP1.

FIG. 5 is a table of trim position changes conducted in the abovementioned first trim position control. Herein, the shift operation changes between states 1, 2, 3, 4, in order. For example, in pattern 1 in FIG. 5, the shift position is changed from the forward movement position (F) to the second operating position (N). Next, the shift position is changed from the second operating position (N) to the forward movement position (F).

In pattern 1, if the trim position is the second up trim position UP2 while the shift position is the forward movement position (F), the trim position is changed from the second up trim position UP2 to the neutral trim position N when the shift position is changed from the forward movement position (F) to the second operating position (N). When the shift position is changed from the second operating position (N) to the forward movement position (F), the trim position is returned from the neutral trim position N to the second up trim position UP2.

If the trim position is the first up trim position UP1, or if the trim position is the first down trim position DN1, or similarly if the trim position is the second down trim position DN2 while the shift position is the forward movement position (F), the trim position is changed to the neutral trim position N when the shift position is changed from the forward movement position (F) to the second operating position (N). When the shift position is changed from the second operating position (N) to the forward movement position (F), the trim position is returned from the neutral trim position N to the original position. When the trim position is the neutral trim position N while the shift position is the forward movement position (F), the trim position is maintained in the neutral trim position N regardless of any change in the shift position.

In pattern 2 in FIG. 5, the shift position is changed from the forward movement position (F) to the first operating position (R). Next, the shift position is changed from the first operating position (R) to the forward movement position (F). In the pattern 2, if the trim position is the second up trim position UP2 while the shift position is the forward movement position (F), the trim position is changed from the second up trim position UP2 to the neutral trim position N when the shift position is changed from the forward movement position (F) to the first operating position (R). When the shift position is changed from the first operating position (R) to the forward movement position (F), the trim position is returned from the neutral trim position N to the second up trim position UP2.

If the trim position is the first up trim position UP1, if the trim position is the first down trim position DN1, or similarly if the trim position is the second down trim position DN2 while the shift position is the forward movement position (F), the trim position is changed to the neutral trim position N when the shift position is changed from the forward movement position (F) to the first operating position (R). When the shift position is then changed from the first operating position (R) to the forward movement position (F), the trim position is returned from the neutral trim position N to the original position.

In pattern 3 in FIG. 5, first, the shift position is changed from the forward movement position (F) to the first operating position (R). Next, the shift position is changed from the first operating position (R) to the second operating position (N). Next, the shift position is changed from the second operating position (N) to the forward movement position (F). In pattern 3, when the shift position is changed from the forward movement position (F) to the first operating position (R), the trim position is changed to the neutral trim position N in the same way as in pattern 2. However, even if the shift position is changed from the first operating position (R) to the second operating position (N), the trim position is maintained as the neutral trim position N. When the shift position is changed from the second operating position (N) to the forward movement position (F), the trim position is returned from the neutral trim position N to the original position in the same way as in pattern 1. When the trim position is in the neutral trim position N while the shift position is the forward movement position (F) in pattern 3, the trim position is maintained in the neutral trim position N regardless of any change in the shift position.

As described above, when the shift position is changed from the forward movement position (F) to the second operating position (N), the deflector 54 moves to the neutral trim position N. As a result, the boat body 2 can be stabilized and held in a fixed position. Alternatively, the boat body 2 can be made to decelerate in a stable manner. When the shift position is changed from the forward movement position (F) to the first operating position (R), the deflector 54 moves to the neutral trim position N. As a result, the boat body can be made to move in reverse in a stable manner. Alternatively, the boat body 2 can be made to decelerate in a stable manner.

Moreover, when the operator returns the shift position from the second operating position (N) or the first operating position (R) to the forward movement position (F), the deflector 54 automatically returns from the neutral trim position N to the original trim position. Therefore, operation is convenient since the operator does not need to use the trim adjustment portion 43 to manually reset the position of the deflector 54.

Figure 6:
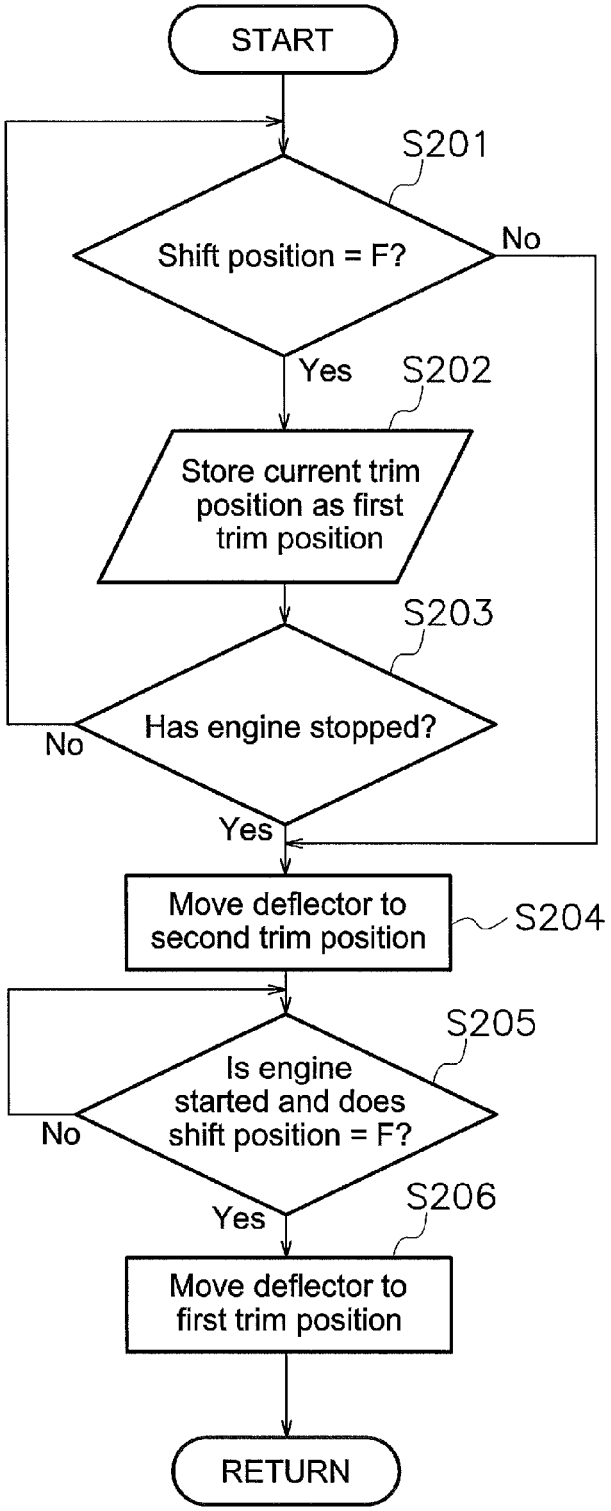
FIG. 6 is a flow chart of a second trim position control processing.

The deflector control portion 463 conducts trim position control even when the engine 3 is stopped or when the jet propulsion boat 100 starts traveling on water. The following is an explanation of the trim position control (referred to below as "second trim position control") when the engine 3 is stopped and when the jet propulsion boat 100 starts traveling. FIG. 6 is a flow chart of the second trim position control processing.

In step S201, the deflector control portion 463 is programmed to determine whether the shift position is the forward movement position (F) in the same way as in step S101. The routine advances to step S202 if the shift position is the forward movement position (F). In step S202, the deflector control portion 463 stores the current trim position in the storage portion 464 in the same way as in step S102.

In step S203, the deflector control portion 463 is programmed to determine whether the engine 3 is stopped. For example, the deflector control portion 463 determines that the engine 3 is stopped upon receiving an engine stop signal from the engine stop operating portion 45. The routine returns to step S201 if the deflector control portion 463 determines that the engine 3 is not stopped. If the deflector control portion 463 determines that the engine 3 is stopped, the routine advances to step S204. Further, the routine advances to step S204 if the shift position is not in the forward movement position (F) in step S201. In step S204, the deflector control portion 463 is programmed to cause the deflector 54 to be moved to the second trim position in the same way as in step S104. Specifically, the deflector 54 moves to the neutral trim position N.

In step S205, the deflector control portion 463 is programmed to determine whether the engine 3 is started and the shift position is the forward movement position (F). The engine 3 having started and the shift position being the forward movement position (F) signify that the jet propulsion boat 100 has started traveling. For example, the deflector control portion 463 is programmed to determine that the engine 3 is started upon receiving an engine start-up signal from the engine start-up operating portion 44. If the engine 3 is not started and the shift position is not the forward movement position (F), the routine returns to the determination in step S205. Specifically, the deflector 54 is held in the neutral trim position N. If the engine 3 is started and the shift position is the forward movement position (F), the routine advances to step S206.

In step S206, the deflector control portion 463 is programmed to cause the deflector 54 to be moved to the first trim position in the same way as in step S106. Specifically, the deflector control portion 463 returns the deflector 54 to the trim position stored in the storage portion 464 in step S202.

FIG. 7 is a table of trim position changes conducted in the above-mentioned second trim position control. Here, the state of the jet propulsion boat 100 is changed in order from traveling to engine stop to engine start-up to traveling. When the jet propulsion boat 100 is traveling, the shift position is the forward movement position (F). When the engine is stopped or is started, the shift position is the second operating position (N).

If the trim position is the second up trim position UP2 while the jet propulsion boat 100 is traveling, the trim position is changed from the second up trim position UP2 to the neutral trim position N when the engine 3 is stopped. When the engine 3 is started, the trim position is maintained in the neutral trim position N. If the shift position is changed from the second operating position (N) to the forward movement position (F) when the jet propulsion boat 100 starts traveling, that is, after the engine 3 has been started, the trim position is returned from the neutral trim position N to the second up trim position UP2.

If the trim position is the first up trim position UP1, if the trim position is the first down trim position DN1, or similarly if the trim position is the second down trim position DN2 while the jet propulsion boat 100 is traveling, the trim position is changed to the neutral trim position N when the engine 3 is stopped. When the engine 3 is started, the trim position is maintained in the neutral trim position N. The trim position is returned from the neutral trim position N to the original position when the jet propulsion boat 100 starts traveling. If the trim position is the neutral trim position N while the jet propulsion boat 100 is traveling, the trim position is maintained in the neutral trim position N regardless of any change in the shift position.

As described above, the deflector 54 moves to the neutral trim position N when the engine 3 is stopped. As a result, the boat body 2 can be held in a fixed position in a stable manner when the engine 3 is started. Moreover, when the shift position is changed to the forward movement position (F) after the engine 3 has been started, that is, when the jet propulsion boat 100 starts traveling, the deflector 54 automatically returns from the neutral trim position N to the original trim position. Therefore, operation is convenient since the operator does not need to use the trim adjustment portion 43 to manually reset the position of the deflector 54.

Although preferred embodiments of the present invention have been described so far, the present invention is not limited to the above preferred embodiments and various modifications may be made within the scope of the present invention.

The jet propulsion boat may be another type of jet propulsion boat without being limited to a personal watercraft. For example, the jet propulsion boat may be a jet boat.

In the above preferred embodiments, the storage portion 464 preferably stores the position of the deflector 54 set by the trim adjustment portion 43 as the first trim position. However, the first trim position may be a specific position stored as a prescribed value in the storage portion 464. Thus, operation is convenient since the operator does not need to manually switch the position of the deflector 54.

The movement of the bucket 55 is not limited to an electrical control and the bucket 55 may be moved by an operating force on the shift operating portion 42 transmitted to the bucket 55. For example, the operating force on the shift operating portion 42 may be transmitted to the bucket 55 by a mechanical transmission such as a wire and the like. In this case, the shift position of the bucket 55 is preferably detected by a sensor.

The second trim position is not limited to the neutral trim position N and may be another position. However, the second trim position is preferably the neutral trim position N in order for the boat body 2 to be stabilized.

The number of trim adjustment positions is not limited to five. The number of trim adjustment positions may be four or less, or six or more. Alternatively, the trim adjustment positions are not limited to graduated positions and may be unprescribed continuous positions.

The controller 46 may be configured as a plurality of portions. For example, the controller 46 may include an engine control portion and a boat control portion. The engine control portion is programmed to control the engine 3. The boat control portion is programmed to control the trim position and the shift position. In this case, the engine control portion and the boat control portion preferably are able to communicate with each other.

If the jet propulsion boat 100 includes a sensor to detect a position of the bucket 55, the deflector control portion 463 may determine the shift position on the basis of the position of the bucket 55 detected by the sensor.

If the jet propulsion boat 100 includes a sensor to detect a position of the deflector 54, the deflector control portion 463 may store the trim position of the deflector 54 detected by the sensor in the storage portion 464 as a present trim position.

The deflector control portion 463 may cause the deflector 54 to be moved to the first trim position when the engine 3 is started instead of when the engine 3 is stopped in the second trim position control. Specifically, when the engine 3 is stopped, the deflector control portion 463 maintains the deflector 54 at the trim position when the jet propulsion boat 100 is traveling. The deflector 54 is moved to the first trim position when the engine 3 is started.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propulsion boat comprising:

a boat body;

an engine housed inside the boat body;

a jet propulsion mechanism configured to generate a propulsion power from a driving power of the engine;

a deflector including a jet orifice to discharge a jet flow backward from the jet propulsion mechanism, the deflector being arranged to swing upward and downward to change a direction of the jet flow upward and downward;

a bucket disposed behind the deflector, the bucket configured to move between a forward movement position in which the bucket is moved away from a position facing the jet orifice and an operating position in which the bucket faces the jet orifice;

a shift operating portion configured to be switched between a forward movement shift position corresponding to the forward movement position of the bucket and an operating shift position corresponding to the operating position of the bucket;

a deflector drive mechanism configured to cause the deflector to swing;

a trim adjustment portion to adjust a position of the deflector;

a storage portion that stores a first trim position and a second trim position as swing positions of the deflector; and a deflector control portion programmed to cause the deflector to swing by controlling the deflector drive mechanism in response to an operation of the shift operating portion, to cause the deflector to move to the first trim position when the shift operating portion is switched to the forward movement shift position, and to cause the deflector to move to the second trim position when the shift operating portion is switched to the operating shift position; wherein the first trim position includes an up trim position, a neutral trim position, and a down trim position;

the deflector control portion stores the position of the deflector set by the trim adjustment portion in the storage portion as the first trim position when the shift operating portion is set to the forward movement shift position; and the deflector control portion is programmed to return the deflector from the second trim position to the first trim position stored in the storage portion when the shift operating portion is switched from the operating shift position to the forward movement shift position.

2. The jet propulsion boat according to claim 1, further comprising:

a bucket drive mechanism configured to cause the bucket to move; and a bucket control portion programmed to cause the bucket to move by controlling the bucket drive mechanism in response to an operation of the shift operating portion, to cause the bucket to move to the forward movement position when the shift operating portion is set to the forward movement shift position, and to cause the bucket to move to the operating position when the shift operating portion is set to the operating shift position.

3. The jet propulsion boat according to claim 2, wherein the deflector drive mechanism and the bucket drive mechanism are arranged to allow mutually independent movement of the deflector and the bucket, respectively.

4. The jet propulsion boat according to claim 3, wherein the bucket drive mechanism includes a first electric motor, and the deflector drive mechanism includes a second electric motor that is controlled independently of the first electric motor.

5. The jet propulsion boat according to claim 1, wherein the second trim position is a specific position stored as a prescribed value in the storage portion.

6. The jet propulsion boat according to claim 5, wherein the second trim position is a position of the deflector that does not move the boat body forward or reverse.

7. The jet propulsion boat according to claim 6, wherein the deflector control portion causes the deflector to move to the second trim position when the engine is started or stopped.

* * * * *